United States Patent [19]

Laimer

[11] 4,243,208

[45] Jan. 6, 1981

[54] CONVERTER PLANT

[75] Inventor: Friedrich Laimer, Perg, Austria

[73] Assignee: Voest-Alpine Aktiengesellschaft, Linz, Austria

[21] Appl. No.: 39,750

[22] Filed: May 17, 1979 (Under 37 CFR 1.47)

[30] Foreign Application Priority Data

May 24, 1978 [AT] Austria ..... 3769/78

[51] Int. Cl.[3] ..... C21C 5/38

[52] U.S. Cl. ..... 266/158; 98/115 R; 266/159

[58] Field of Search ..... 266/144, 158, 159, 216, 266/245; 164/256; 414/185, 191, 291; 98/115 R, 115 VM

[56] References Cited

U.S. PATENT DOCUMENTS

| | | | |
|---|---|---|---|
| 3,809,376 | 5/1974 | Plazier | 266/158 |
| 4,143,864 | 3/1979 | Laimer et al. | 266/158 |

*Primary Examiner*—L. Dewayne Rutledge
*Assistant Examiner*—Michael L. Lewis
*Attorney, Agent, or Firm*—Brumbaugh, Graves, Donohue & Raymond

[57] ABSTRACT

In a converter plant including a tiltable converter surrounded by a casing to whose ceiling a principal discharge conduit for conducting away refining gases is connected, part of the casing is fastened to a charging device and is displaceable with the same. The charging device is designed as a portal crane displaceable in the direction of the tilting axis of the tiltable converter. A cellular casing part is fastened to the portal crane, is open towards the tiltable converter and has a gas-discharge opening in the ceiling. The remaining casing part is closed, and the cellular part, in the charging position and, if desired, also in the pouring-off position, closes the casing and the discharge opening lies below an additional discharge conduit for conducting away secondary emissions.

5 Claims, 5 Drawing Figures

CONVERTER PLANT

BACKGROUND OF THE INVENTION

The invention relates to a converter plant including a tiltable converter surrounded by a casing to whose ceiling a principal discharge conduit for conducting away refining gases is connected, part of which casing is fastened to a charging arrangement and is displaceable with the same.

When a converter of a steel-making plant is in operation, flue gases escape from the converter mouth during refining, which gases mainly consist of carbon oxides and FeO-particles carried away therewith. These flue gases, which are also referred to as principal emissions, have to be cleaned, and the energy contained therein possibly has to be regained before being released into the atmosphere. Also when charging a converter with scrap and pig iron and tapping the molten steel into the casting ladle, intensive smoke will sometimes develop, which smoke is referred to as secondary emissions. An even greater nuisance in terms of the development of smoke and fume is caused in steel-making plants with bottom-blowing converters, e.g. when carrying out the OBM-process, since the introduction of auxiliary agents into the bottom valves of such converters leads to spatters in the form of showers of sparks.

In recent times and in highly developed industrial countries, strict regulations with respect to the prevention and reduction of the emissions, and also regulations for increasing the safety of the operating personnel, have been introduced. The known arrangements for conducting away converter flue gases do not meet these high demands.

The known arrangements for conducting away flue gases comprise hoods surrounding the converter mouth and connected to discharge conduits that can seize reliably neither the principal emissions nor the secondary emissions. Also an arrangement has become known (German Offenlegungsschrift No. 22 33 443) in which a converter of a steel-making plant is enclosed on all sides with only a little more space than is needed for a tilting movement of the converter. Charging of the converter is effected through a lateral opening into which the lip of the charging container or a charging channel is introduceable. During charging, the charging opening remains open, and therefore it is not possible to prevent noxious substances of the secondary emissions to escape through the charging opening, thereby reaching the atmosphere and endangering safety. This danger exists particularly with OBM-converters during the admittance of gases to the bottom valves.

Furthermore, a plant is known (Austrian patent No. 329,895) in which a stationary melting furnace, in particular an electro-arc furnace is surrounded by a casing, wherein a crane can be passed over the furnace. Plates are fastened to the crane at distances which alternately close a casing opening during movement in and out by the crane. Such arrangements are, however, not suited for converter plants in which large amounts of flue gases emerge during the refining phase. Efficient converter plants have to include two discharge conduits, i.e. one for the primary and one for the secondary emissions.

SUMMARY OF THE INVENTION

The invention aims at avoiding the disadvantages pointed out and has as its object to provide a converter plant in which the gases emerging both during refining and during charging and pouring are safely seized and the escaping of these gases from the plant into the hall is reliably avoided. A charging crane, if desired, being employable for several adjacently arranged converters in this arrangement.

This object is achieved according to the invention in that the charging arrangement is designed as a portal crane that is displaceable in the longitudinal direction of the hall, i.e. in the direction of the tilting axis of the converter(s), and on which a cellular part of a casing is fastened. This casing is open towards the converter and has a discharge opening for gas in the ceiling, but is closed over the remaining part. The cellular part, in the charging position and possibly also in the pouring position, closes the casing, and the discharge opening in the ceiling moves below an additional discharge conduit for conducting away the secondary emissions.

Suitably, a semi-portal crane is mounted on the working platform and on an intermediate craneway girder arranged at the ceiling of the casing.

For taking up charging containers or the like placed on the working platform, by means of the lifting device of the semi-portal crane, the cell walls can be designed in several parts, one wall part being movable for laterally introducing the charging container.

A further favorable possibility of taking up charging containers involves an opening provided in the working platform for permitting the lifting of charging containers or the like from the mill floor level by means of the lifting device of the portal crane.

BRIEF DESCRIPTION OF THE DRAWINGS

The invention will now be described in more detail by way of exemplary embodiments and with reference to the accompanying drawings, wherein.

DESCRIPTION OF EXEMPLARY EMBODIMENTS

Figure 1:
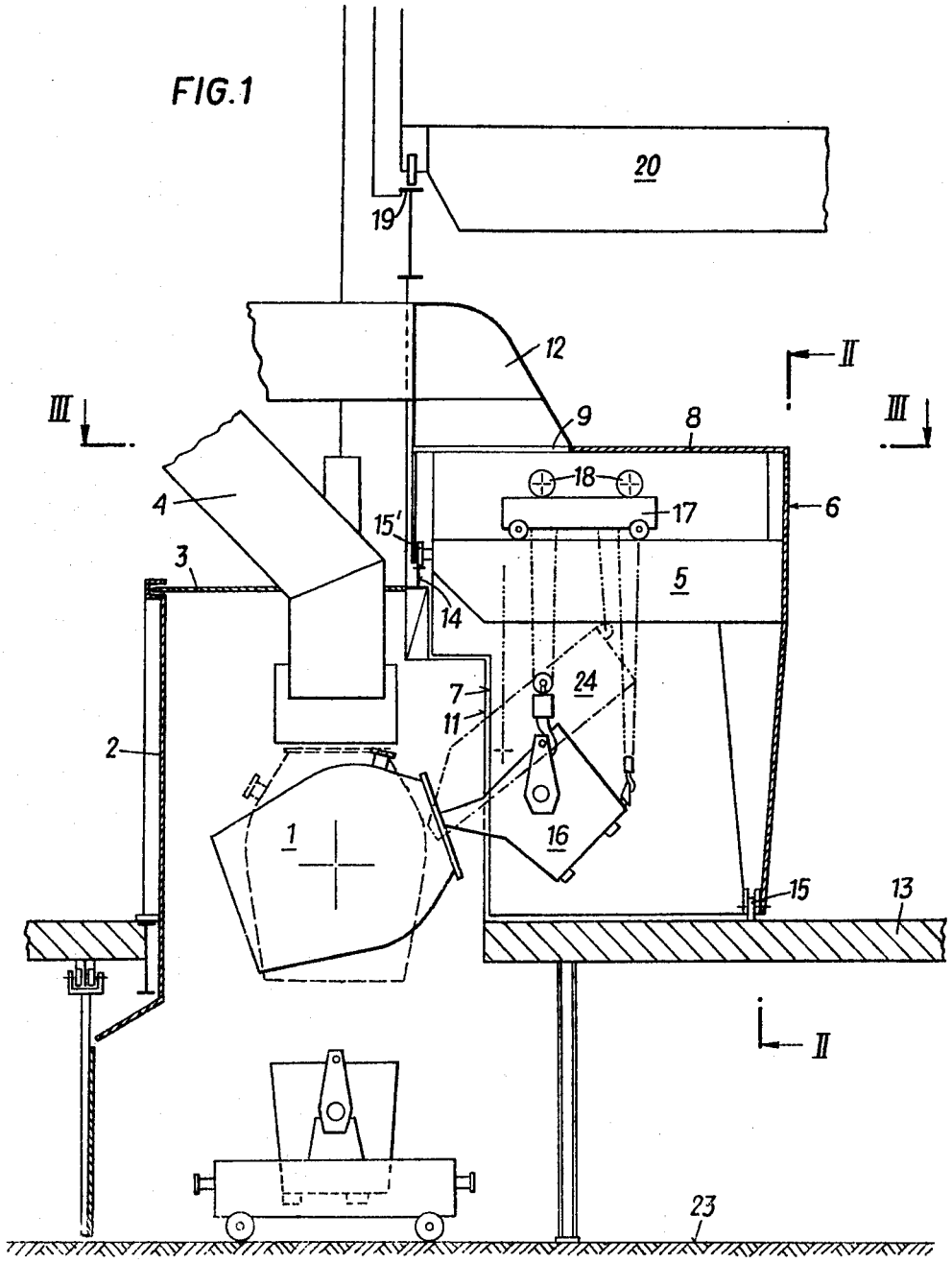
FIG. 1 is a side sectional view of the converter plant along line I—I of FIG. 3, with the side walls of the casing removed.

In FIG. 1 a converter 1 that is tiltable about a horizontal axis is surrounded by a casing 2 to whose ceiling 3 a principal discharge conduit 4 is connected for diverting off the principal emissions forming during refining. A cellular part 6 is fastened to a semi-portal crane 5 displaceable in the longitudinal direction of the hall, which cellular part may be designed in the ground sectional view approximately like a U (FIG. 3) and which is open at the side 7 of the converter. This part 6 has an opening 9 in the ceiling 8. In the position illustrated in FIGS. 1 to 3, the cell side walls 10 and 10' are adjacent to the front limitation 11 of the casing in such a manner that the casing is closed on all sides and the ceiling opening 9 of the cellular part 6 is below an additional discharge conduit 12, thus creating a connection therewith. This additional discharge conduit 12 may enter into the principal discharge conduit 4, wherein the flue gases can be drained to a common filtering arrangement. The semi-portal crane 5 is supported by means of rollers 15, 15' on the working platform 13 and an intermediate craneway girder 14 that is fastened to the ceiling 3 of the casing. It is displaceable in the longitudinal direction of the hall, between loading stations and the charging position, or a plurality of charging positions in the case of a plurality of converters. The charging container 16, which in the embodiment is designed as a ladle (drawn in full lines), hangs from a trolley 17 and is tiltable into the charging position with lifting means 18. Above the additional discharge conduit 12, a craneway 19 is provided for a travelling crane 20 of the hall, which crane is not impeded by the operation of the semi-portal crane running below the same.

Figure 2:
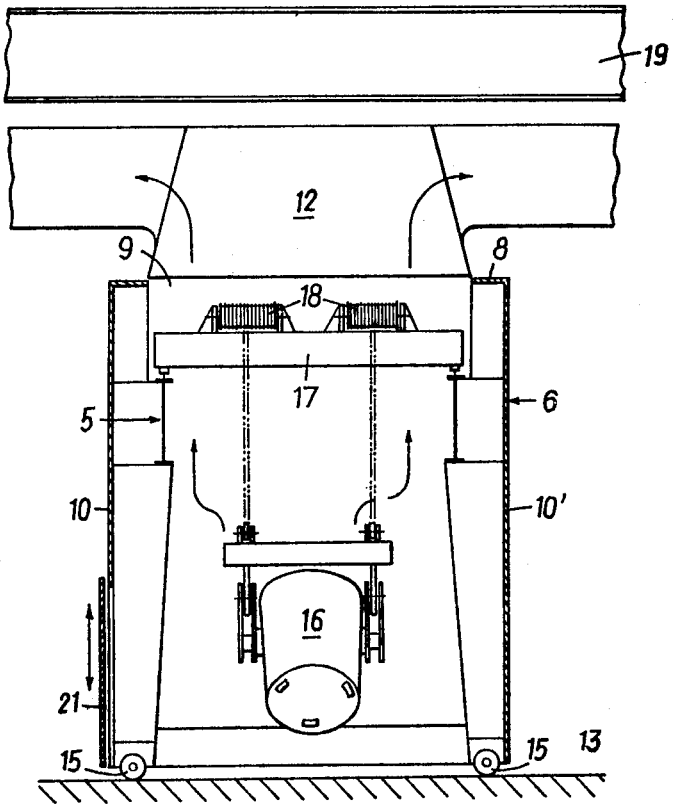
FIG. 2 is a front sectional view of the cellular part of the casing according to line II—II in FIG. 1, with the front wall removed, and showing the connection of the discharge opening to the additional discharge conduit.
Figure 3:
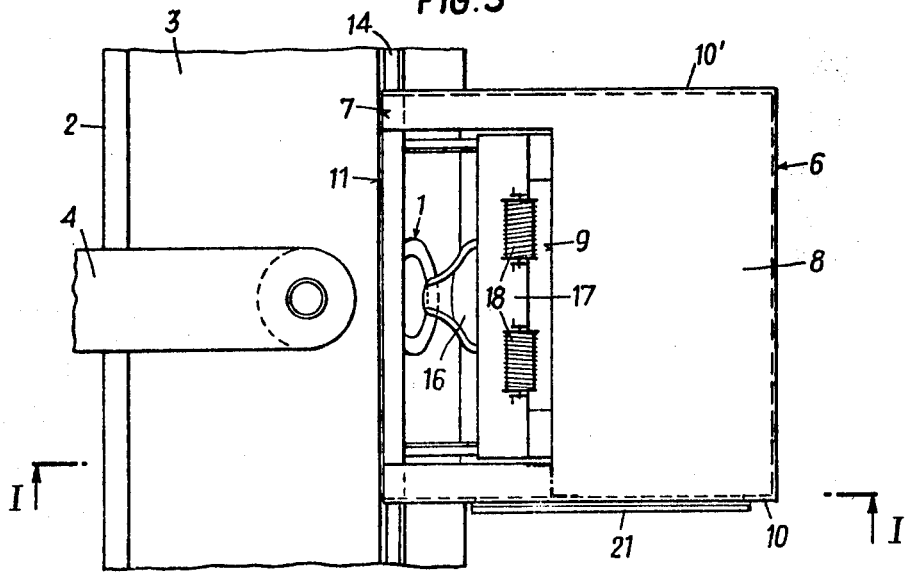
FIG. 3 shows the plant in the ground sectional view according to line III—III of FIG. 1.
Figure 4:
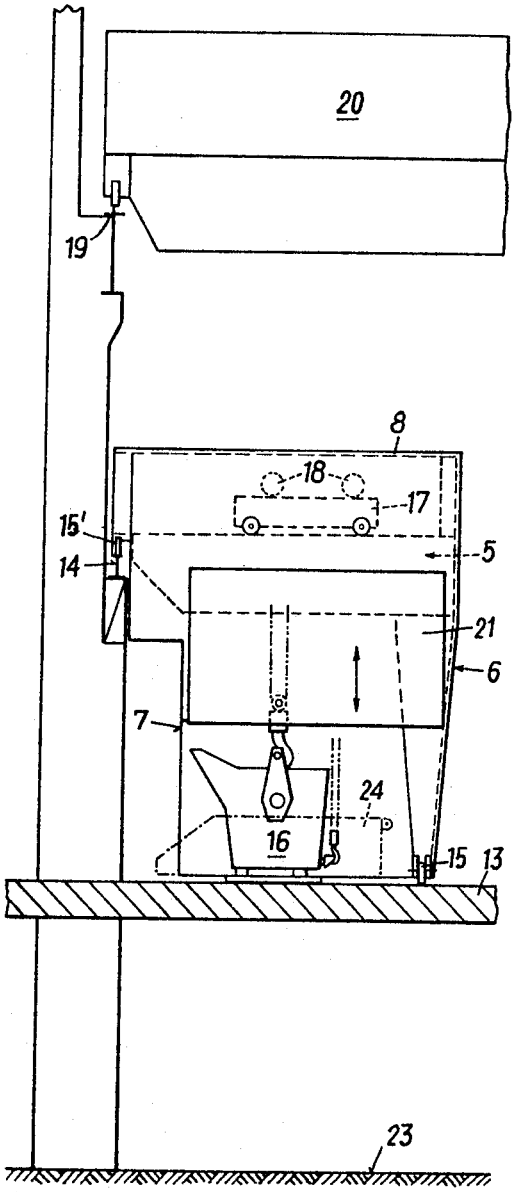
FIG. 4 is a side view of a charging container on the working platform after the lifting of a wall part of the cell.

As illustrated in FIGS. 2 to 4, one side wall 10 of the cellular part 6 is designed in two parts, the lower part being designed as a liftable and lowerable door 21. When the door is lifted, the semi-portal crane 5, together with the cellular part 6 fastened thereto, can move over a charging container disposed on the working platform 13 and take up the same.

Figure 5:
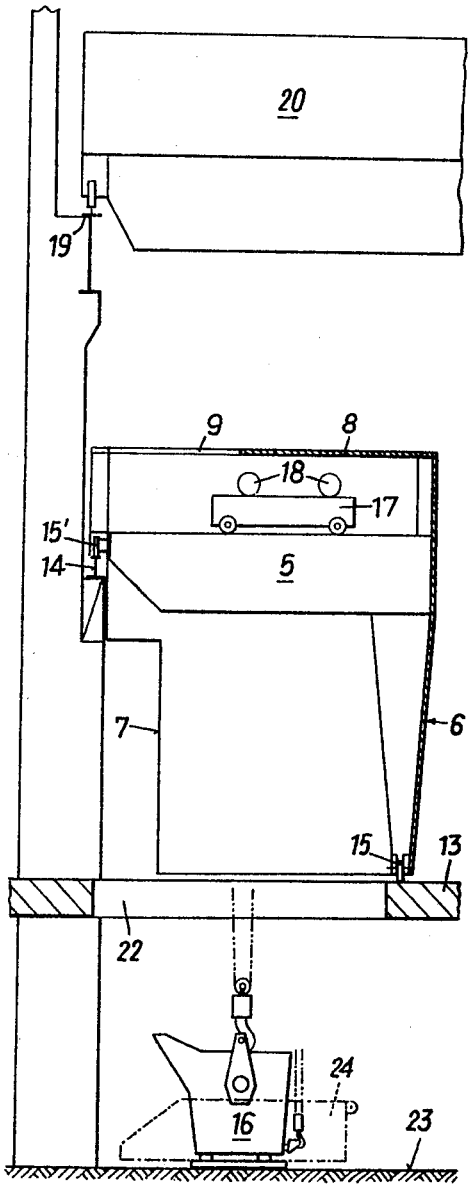
FIG. 5 is a side view of a charging container to be taken up from the mill floor level through an opening in the working platform.

According to FIG. 5, there is an opening 22 in the working platform 13. With this alternative, a charging container 16 disposed on the mill floor level 23 can be taken up from below by the lifting means 18, and then moved into the charging position.

Operation of the plant is effected in such a way that, at first, the converter 1 is charged with scrap. For this purpose, the travelling crane 20 installed on the upper craneway 19 moves a loaded scrap chute 24 to a delivery position. This may be on the working platform 13 or on the mill floor level 23, as is illustrated in FIGS. 4 and 5. The semi-portal crane 5 takes over the scrap chute 24, moving it into the charging position, in which charging takes place by tilting of the scrap chute into the mouth of the converter which is also tilted. This position is shown in FIG. 1 by dot-and-dash lines. The flue gases emerging during charging, i.e. the secondary emissions, stream through the cellular part 6 of the casing, past the trolley 17 and reach the secondary discharge conduit 12, while the hall itself remains free from smoke.

Subsequently, the converter 1 is charged with pig iron, the pig iron ladle 16 being taken over in the same way from a delivery position by the semi-portal crane 5. After tilting of the converter into the vertical blowing position (in FIG. 1 illustrated in broken lines), refining takes place and the flue gases emerging from the converter are taken up by the principal discharge conduit 4.

Also when pouring off the molten steel, smoke may develop, namely to a larger extent when carrying out an OBM-process than when carrying out an LD-process. While it generally will not be necessary to totally close the casing during the LD-process, a way of utilizing the arrangement according to the invention when pouring off the steel, may involve bringing the semi-portal crane 5 with the cellular part 6 into the closing position without a container actually being on the crane. With this type of utilization, pouring off is effected with the casing closed.

What I claim is:

1. In a converter plant of the type including a tiltable converter provided in a hall, a casing surrounding said tiltable converter and having a casing ceiling, a principal discharge conduit for conducting away refining gases connected to said casing ceiling, and a charging device adapted to carry a charging container into a charging position, said casing having a casing part fastened to said charging device and displaceable with said charging device, the improvement which is characterized in that said charging device is designed as a portal crane displaceable in the direction of the tilting axis of said tiltable converter, said casing part is designed as a cellular casing part fastened to said portal crane, which cellular casing part has walls open towards said tiltable converter, but otherwise surrounding the portal crane, and has a casing part ceiling, a gas-discharge opening is provided in said casing part ceiling, and an additional discharge conduit is provided for conducting away secondary emissions, the arrangement being such that, at least in the charging position, said cellular casing part closes said casing and said gas-discharge opening in said casing part ceiling is below said additional discharge conduit.

2. A converter plant as set forth in claim 1, wherein said cellular casing part closes said casing and said gas-discharging opening is below said additional discharge conduit, also when the converter is in pouring-off position.

3. A converter plant as set forth in claim 1 with a working platform, wherein an intermediate craneway girder is provided at said casing ceiling, and wherein said portal crane is designed as a semi-portal crane supported on said working platform and said intermediate craneway girder.

4. A converter plant as set forth in claim 1 or 3, wherein said cellular casing part has side walls, said side walls being designed to comprise at least two wall parts, one of said wall parts being movable to allow for a lateral introduction of said charging container.

5. A converter plant as set forth in claim 1 or 3, comprising a mill floor to accommodate charging containers, and a working platform with an opening, wherein said portal crane includes lifting means for lifting said charging containers from said mill floor through said opening.

* * * * *